US005898786A

United States Patent [19]

Geisenberger

[11] Patent Number: 5,898,786

[45] Date of Patent: Apr. 27, 1999

[54] LOUDSPEAKERS

[75] Inventor: Stefan Geisenberger, Straubing, Germany

[73] Assignee: Nokia Technology GmbH, Pforzheim, Germany

[21] Appl. No.: 08/848,388

[22] Filed: May 8, 1997

[30] Foreign Application Priority Data

May 10, 1996 [DE] Germany ..... 196 18 898

[51] Int. Cl.[6] ..... H04R 25/00

[52] U.S. Cl. ..... 381/416; 381/412; 381/420; 381/421

[58] Field of Search ..... 381/412, 400, 381/416, 423, 432, 430; 396/420, 421

[56] References Cited

U.S. PATENT DOCUMENTS

| | | | |
|---|---|---|---|
| 2,551,447 | 5/1951 | Marquis | 381/416 |
| 3,109,072 | 10/1963 | Price | 381/416 |
| 3,250,862 | 5/1966 | Rollins | 681/416 |
| 5,390,257 | 2/1995 | Oslac et al. | 381/199 |
| 5,590,210 | 12/1996 | Matsuo et al. | 381/199 |

FOREIGN PATENT DOCUMENTS

| | | | |
|---|---|---|---|
| 581129-A1 | 2/1994 | European Pat. Off. | 381/199 |
| 8101781 | 7/1981 | France . | |
| 2941615 | 5/1980 | Germany . | |
| 3229875 | 2/1983 | Germany . | |
| 3730305 | 3/1989 | Germany . | |
| 3936639 | 3/1991 | Germany . | |
| 4113017 | 10/1992 | Germany . | |
| 4126121 | 2/1993 | Germany . | |
| 4225854 | 2/1994 | Germany . | |

*Primary Examiner*—Sinh Tran
*Attorney, Agent, or Firm*—Ware, Fressola, Van Der Sluys & Adolphson LLP

[57] ABSTRACT

A loudspeaker (10) with a magnet system (12) arranged in a space (32) surrounded by a conical diaphragm (14) has a core (20) of the magnet system (12) first connected to the loudspeaker basket (11) and only then is the pot (19) connected to the core 20. It is then possible to manufacture loudspeakers (10) with internally located magnet systems (12) on production lines which can also be used to manufacture loudspeakers with magnet systems (12) that are located on the outside of the basket (11). Because the pot (19) is only installed later in the core (20) a centering bushing (34) can be placed between the core (20) and the voice coil support (18), which leads to a considerable improvement in the production quality of such loudspeakers (10).

4 Claims, 5 Drawing Sheets

LOUDSPEAKERS

BACKGROUND OF THE INVENTION

The invention concerns the construction and a method of manufacturing loudspeakers containing a magnet system located in the diaphragm cone.

TECHNICAL FIELD OF THE INVENTION

Discussion of the Related Art

In accordance with the state of the art loudspeakers are usually constructed by first manufacturing a magnet system which is then connected to a loudspeaker basket. An oscillating unit is then installed in this part which comprises a diaphragm, a bead, a centering spider and a voice coil support equipped with the voice coil. Such an arrangement is shown in DE-A-4113017 for example. In order for the voice coil or the voice coil support to remain centered along the loudspeaker center line during the insertion of the oscillating unit, the DE-A-4113017 shows a unit containing the magnet system which is installed on the outside of the basket and a centering bushing is inserted between the pole body and the voice coil support. Most of these latter steps are automated on the respective production lines.

In addition loudspeakers are known whose magnet system is not installed on the outside of the head, but in most cases is located in the space enveloped by the conical diaphragm. Such an arrangement, which also forms the starting point of the present invention, is shown for example in DE-A-4225854. In that case the magnet system is formed of a pot and a core that is inserted into the pot. The core contains a magnet part and a pole disk.

If a loudspeaker of the type shown in DE-A-4225854 is to be manufactured with high precision on production lines that are also used to manufacture loudspeakers in accordance with DE-A-4113017, this is not possible. The reasons are that with arrangements according to DE-A-4225854 a centering bushing cannot be inserted from above the diaphragm between the voice coil or between the voice coil support and the pole disk, because the magnet system can only be installed and connected after the oscillating unit has been inserted into the basket in the diaphragm funnel. If the manufacturing precision of arrangements according to DE-A-4225854 must be improved for production lines according to DE-A-4113017, it is necessary to manufacture the respective loudspeaker parts in accordance with narrow production tolerances which significantly increases the price of such loudspeakers.

It is furthermore possible to manufacture arrangements according to DE-A-42854 with increased production quality, for example by inserting centering strips between the voice coil support and the pole disk or pole core, through the basket floor. Aside from the fact that this type of centering through the basket floor requires new production lines which can only be used for this type of loudspeaker, the centering by means of strips is also very costly.

SUMMARY OF THE INVENTION

It is therefore the task of the invention to present a loudspeaker with a magnet system located in the diaphragm cone, which according to the indicated method can also be manufactured with very high precision on production lines that can also be used to manufacture loudspeakers with magnet systems which are installed on the outside of the basket.

According to a first aspect of the invention, a loudspeaker with a magnet system comprises a core installed in a pot, with at least one magnet part and a pole disk inserted into the pot, and a conical diaphragm, where most of the magnet system is arranged inside the space surrounded by the conical diaphragm, wherein at least the core is equipped with a centering hole or a centering blind hole, and a centering peg is provided which in the finished condition of the magnet system fills the respective centering hole in the core at least partially.

According to a second aspect of the invention, a method for providing a loudspeaker comprises the steps of forming a loudspeaker basket; forming the core; forming an oscillating system where the diaphragm is equipped with a bead, a centering spider and a voice coil support with a voice coil wound around it; inserting and connecting the core to the loudspeaker basket; inserting the oscillating system into the loudspeaker basket, while a centering bushing is placed between the core and the voice coil support to center the oscillating system; connecting the bead and the centering spider to the loudspeaker basket; removing the centering bushing; placing the top on the core by using the centering hole and the centering peg provided respectively in the core; and connecting the pot to the core.

The basic idea of the present invention is not to fully construct the magnet system prior to its connection with the loudspeaker basket, but to complete the magnet system during the manufacture of the loudspeaker. This stepwise construction of the magnet system allows to manufacture loudspeakers with internally installed magnet systems on production lines which are also used to manufacture loudspeakers with magnet system installed on the outside of the basket, without thereby reducing the production quality of the loudspeakers with internally installed magnet systems. The latter can be attributed to the fact that in a stepwise construction of the magnet system, the normally utilized centering bushings can also be used for loudspeakers with magnet systems installed on the outside of the basket.

The stepwise construction of the magnet system during loudspeaker manufacture acts against a prejudice according to which loudspeaker manufacturers prefer the use of magnet systems equipped with corresponding back closing parts. For example if neodymium, high-grade ferrite or another high-grade magnetic material is used as the material for the magnet, it need not to be feared that a permanent reduction of magnetic values takes place at the usual manufacturing temperatures in magnetic parts that were magnetized before they are connected to the back closing parts. It is a special advantage if the respective magnetic parts are magnetized after they have been connected to the loudspeaker basket, because this allows an expensive connection or a difficult handling of magnetized magnetic parts to be omitted.

If the loudspeaker is constructed in accordance with one embodiment of the invention, the side of the pot that faces away from the core can be used as the installation site for another loudspeaker without the need of providing permanent magnets for the existing magnet parts above the core of said loudspeaker.

An adhesive or screw attachment between the centering peg and the centering hole can be omitted if the loudspeaker is constructed in accordance with other embodiments of the invention. In addition the arrangement indicated according to yet another embodiment makes it possible to increase the clock time on the production line. These and other objects, features and advantages of the present invention will become more apparent in light of the detailed description of a best mode embodiment thereof, as illustrated in the accompanying drawing.

BRIEF DESCRIPTION OF THE DRAWING

FIGS. 2*a–d* are manufacturing steps for a loudspeaker according to FIG. 1 in which:

FIG. 2*a* shows an oscillating unit,

FIG. 2*b* shows a loudspeaker basket,

FIG. 2*c* shows the oscillating unit inserted into the loudspeaker basket with a bushing inserted to center the voice coil during attachment, and FIG. 2*d* shows the pot being installed on the core;

DETAILED DESCRIPTION OF THE PREFERRED EMBODIMENTS

Figure 1:
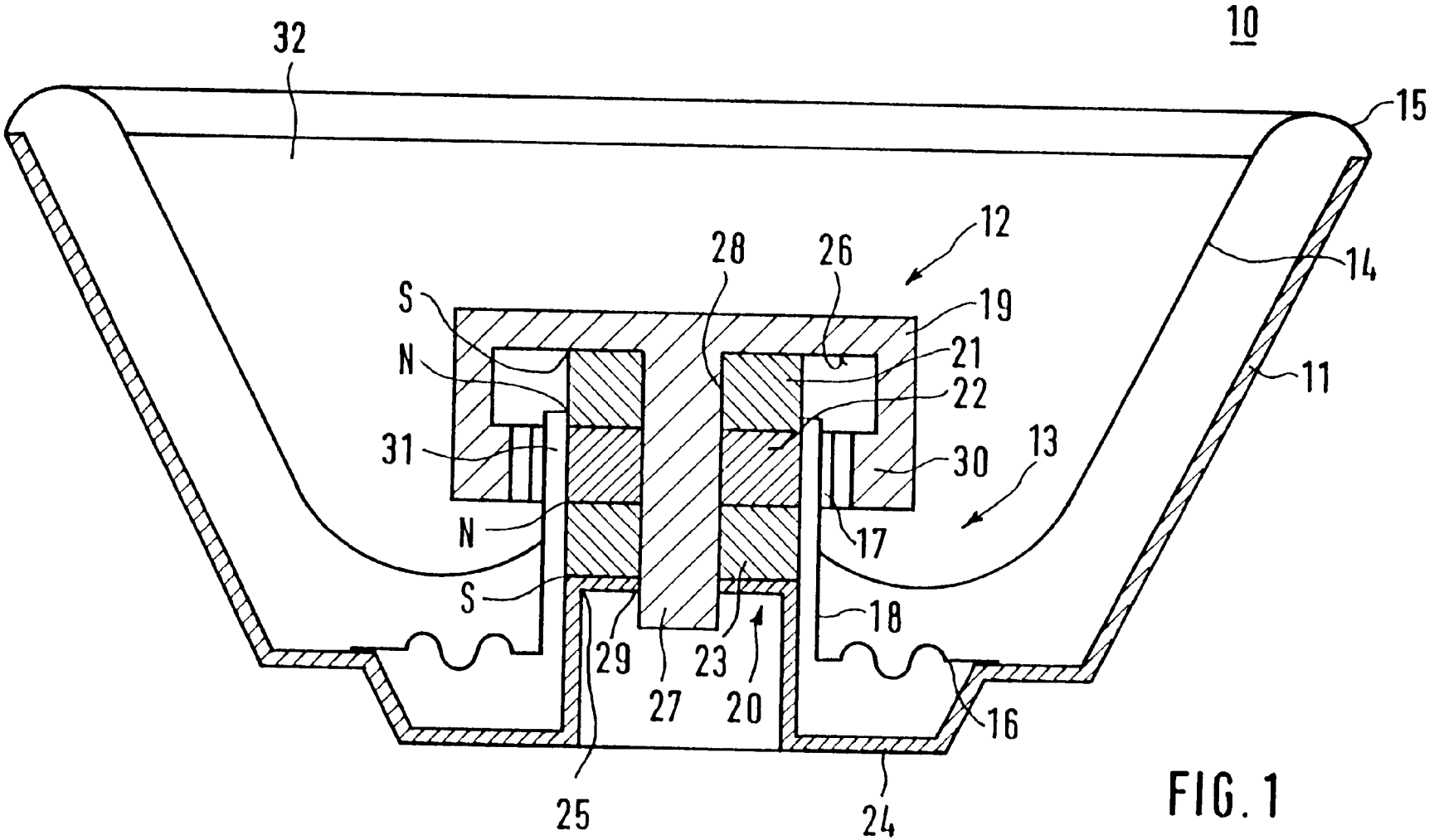
FIG. 1 is a schematic side view of a loudspeaker.

The invention will now be explained in greater detail by means of the figures. FIG. 1 is a schematic side view of a loudspeaker (10). This loudspeaker (10) is essentially formed of a loudspeaker basket (11), a magnet system (12) and an oscillating unit (13). The oscillating unit (13) which is inserted in the loudspeaker basket (11) comprises a conical diaphragm (14), a bead (15), a centering spider (16) and a voice coil support (18) with a voice coil (17) wound around it. To attach the oscillating unit (13) to the basket (11), the outer edges of the centering spider (16) and the bead (15) are cemented to the basket.

The magnet system (12) comprises a core (20) and a pot (19). This core (20) contains three circular disks (21–23) which are stacked in the lengthwise direction of the loudspeaker center line. The middle circular disk (22) forms the so-called pole disk. The two outer circular disks (21, 23) which respectively make contact with different circular surfaces of the pole disk (22), are made of magnetic material and are also called magnet parts in connection with this application. For reasons of completeness it should be pointed out here that in the magnetized condition those circular surfaces of the two magnet parts (21, 23) that face the pole disk (22) have the same polarity. This is indicated in FIG. 1 by a corresponding identification of the poles (N/S) of both magnet parts (21, 23). The stack of circular disks (21–23) is placed on a pedestal (25) on the bottom (24) of the loudspeaker basket (11), where the magnet part (23) makes contact with the pedestal (25).

The pot (19) has a centering peg (27) on the inside of the bottom (26) which is centered with the loudspeaker center line and rests on the magnet part (21), while the centering peg (27) protrudes through the centering holes (28) in the circular disks (21–23) and exits from the pedestal opening (29) because the pedestal also has a hole. Although in the configuration example in FIG. 1 the centering holes (28) in the circular disks (21–23) all have the same inside diameter, because to maintain a high production quality a narrow tolerance is required for the centering holes (28) and the peg (27), and this increases the cost of manufacturing a magnet system (12) according to FIG. 1, in another (not illustrated) configuration example the number of circular disks (21–23) with a narrow inside diameter tolerance can be restricted to one. In that case the pole disk (22) will be the disk whose centering hole (28) centers the centering peg (27) exclusively, because only in this way can a uniform air gap (31) be guaranteed.

Since the inside diameter of the pot edge (30) is larger than the outside diameter of the pole disk (22), the interaction of the two cited components (22, 30) ensures the direction of the air gap (31) along which the voice coil support (18) with the voice coil (17) arranged thereon extends.

Since most of the magnet system (12) in FIG. 1 is arranged in the space (32) surrounded by the conical diaphragm (14), in this connection we also speak of loudspeakers (10) with internally located magnet systems (12).

It should be pointed out in addition to FIG. 1 that the pot (19) and the centering peg (27) can be made in one piece from a material which conducts magnetism. This material can also be used to manufacture the pole disk (22). The loudspeaker basket (11) should be manufactured of a paramagnetic or diamagnetic material in order not to weaken the effect of the magnet system (12) in FIG. 1. Many plastics but also certain metals and metal alloys can be used for that purpose.

The two magnet parts (21, 23) are made of neodymium. However, this does not imply any restriction to that material. Rather in another configuration example the magnet parts (21, 23) can be manufactured of ferrite or AlNiCo, for example. But if the magnet system (12) needs to be constructed very compactly and also provide high induction in the air gap (31), neodymium should be the material of choice.

Figure 2A:
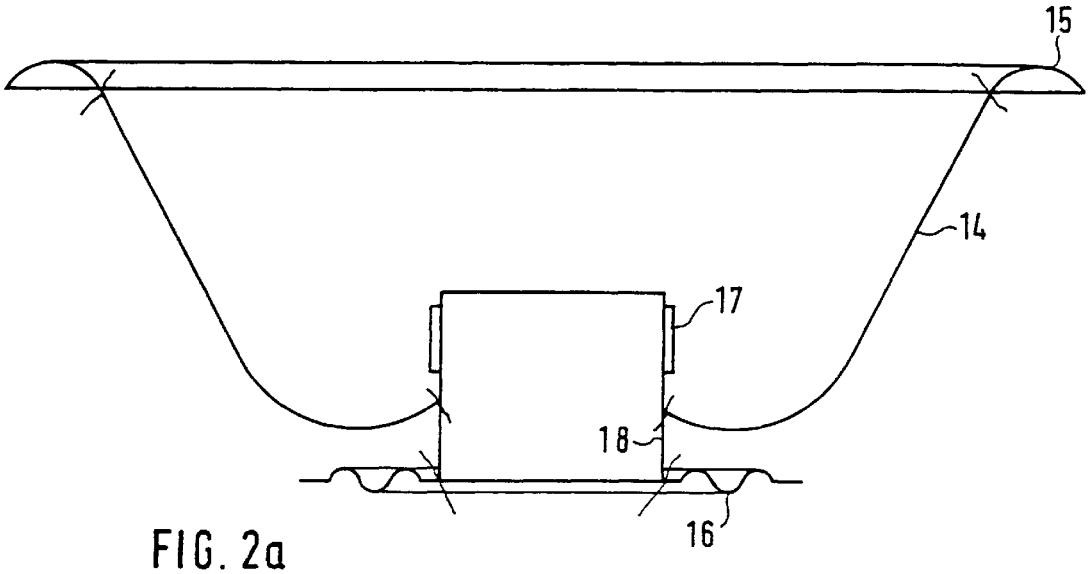

Nor is the use of two magnet parts (21, 23) in the core (20) mandatory. A magnet system which has only one magnet part (21) in the core (20) is explained in greater detail in conjunction with FIG. 3. If a loudspeaker (10) with an internally placed magnet system (12) is to be manufactured on a production line that is also used to manufacture loudspeakers in accordance with DE-A-4113017, this is made possible with the sequence of steps depicted in FIGS. 2*a–d*. To that end it is necessary to build an oscillating unit (13) and a loudspeaker basket (11) simultaneously or sequentially. An accordingly constructed oscillating unit (13) is illustrated in FIG. 2*a*. The snaking lines in this FIG. 2*a* make it clear that the unit is built of a number of component parts. For better visibility the different component parts in FIG. 2*a* have the same reference symbols already used and explained in FIG. 1.

Figure 2B:
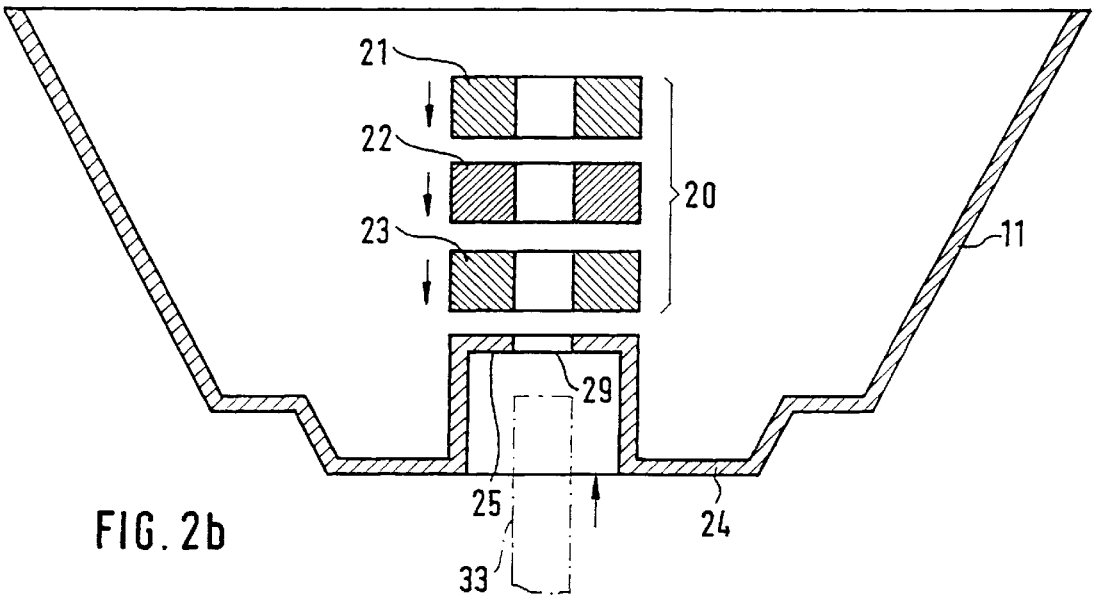

FIG. 2*b* illustrates a loudspeaker basket (11). The illustration clearly shows that the pedestal (25) on the bottom (24) is equipped with a pedestal opening (29).

Once the loudspeaker basket (1 1) is completed, it is necessary to install the core (20) comprising a number of circular disks (21–23), on the pedestal (25). This can be done in many ways. As illustrated in FIG. 2*b*, the different circular disks (21–23) can be stacked on the pedestal (25) in accordance with the arrows. A unit containing all the circular disks (21–23) can be premanufactured and this unit can then be installed on the pedestal (25). The latter is illustrated in greater detail in FIG. 3, however the unit shown there only contains two circular disks (21–23).

When installing the individual circular disks (21–23) or a unit containing the circular disks, it is useful in every instance to insert an installation peg (33) through the pedestal opening (29). Such a condition is illustrated in detail in FIG. 2*c*.

Whether the individual disk or the circular disks (21–23) illustrated in FIG. 2*b* must be connected to each other or to the pedestal (25) depends on the facts of the particular instance, especially on the size of the inside diameter of the various disks (21–23) used in the core (20). If the circular disks (21–23) used in FIG. 1, which are made of a magnetic material, are not yet magnetized when the core (20) is manufactured, an interconnection before the magnetization is not required. By contrast, if magnetized circular disks (21–23) with the same inside diameter as the pole disk (22) are stacked on the installation peg (33), an interconnection between the magnet parts (21, 23) and the pole disk (22) is advisable. The latter also applies when disks (21–23) with different inside diameters are used, as indicated above. Connecting the circular disk (23) to the pedestal (25) after all the disks (21–23) have been installed on the pedestal (25) is not required when the permanent attachment of the core (20) or the disks (21–23) takes place later, for example with the end of the centering peg (27) protruding from the pedestal (25). If only one magnet part (21) is arranged in the core (20) (see FIG. 3) and if the core (20) is to be permanently secured by the end of the peg (27) protruding from the pedestal (25), no connection between the magnet part (21) and the pole disk (22) is required, nor is a connection between the pole disk (22) and the pedestal (25) required, and this regardless of whether this magnet part (21) is magnetized or not, unless the two disks (21, 22) have different inside diameters.

The oscillating unit (13) illustrated in FIG. 2*a* must now be inserted into the loudspeaker basket (11) which is equipped with the core (20). To achieve good centering of the voice coil (17) with respect to the core (20), it is necessary when the oscillating unit (13) is inserted, to install a centering bushing (34) in FIG. 2*c* between the core (20) and the voice coil support (18) as indicated by the arrow next to the centering bushing (34). For reasons of completeness it should be pointed out here that as soon as the oscillating unit (13) has assumed its final position in the loudspeaker basket (11) as shown in FIG. 1, the outer edges of the bead (15) and the centering spider (16) must be connected to the loudspeaker basket (11). Furthermore the centering bushing (34) should remain between the core (20) and the voice coil support (18) until the connection between the oscillating unit (13) and the loudspeaker basket (11) has been established.

The corresponding magnet parts (21, 23) of the core (20) should have been magnetized before the oscillating unit (13) is inserted into the loudspeaker basket (11). To prevent a reciprocal displacement of the different magnet parts (21, 23), by that time the respective magnet parts (21, 23) at least should have been permanently affixed to the pole disk (22).

It must already be pointed out here that the use of magnet parts (21, 23) prior to their connection to a corresponding back closing part (in this case the pot (19)) is critical, because the magnetic properties of the magnet parts (21, 23) without their corresponding back closing parts are temperature-sensitive. This can cause the flux density not to return to its original value after a change in temperature and a subsequent return to the original temperature. For further details reference is made to Koch-Rauschmeyer, Permanent Magnets I, Philips Components, Hamburg, third edition 1991. However if the magnet parts (21, 23) are made of higher-grade materials—such as e.g. neodymium or high-grade ferrites—irreversible flux density changes are ruled out because the temperatures occurring in workshops or warehouses are not able to negatively influence a magnet that was magnetized at a different temperature level. At the same time the temperature on the production line should not be below 10° C. when high-grade ferrites are used, and not above 50° C. for neodymium. Flux density changes caused by the temperature are entirely avoided if the magnet systems (12) are equipped with corresponding back closing parts.

Figure 2C:
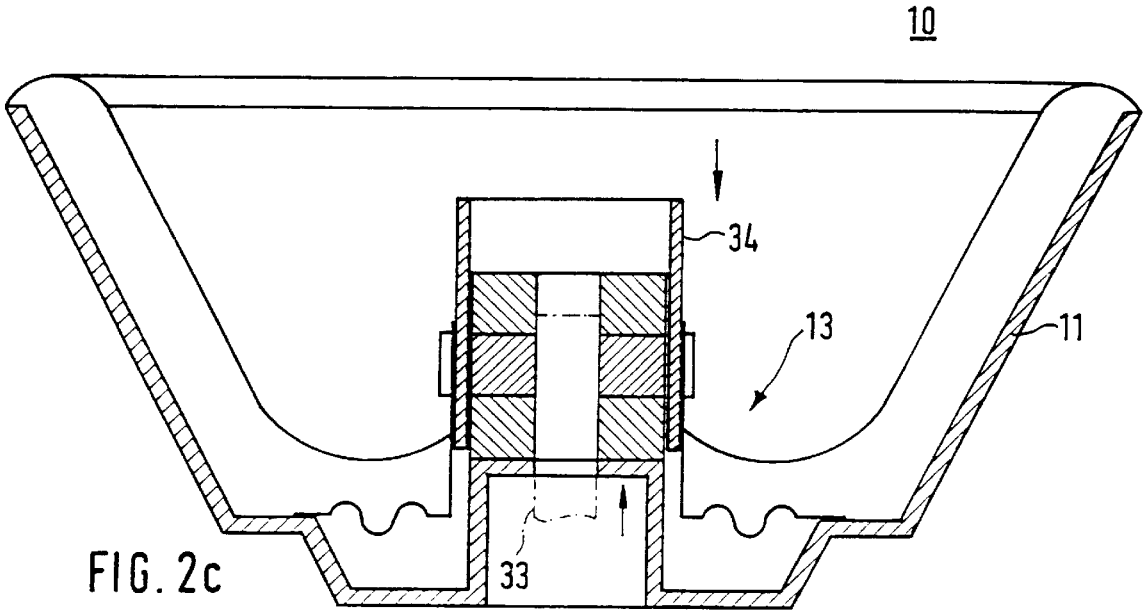
Figure 2D:
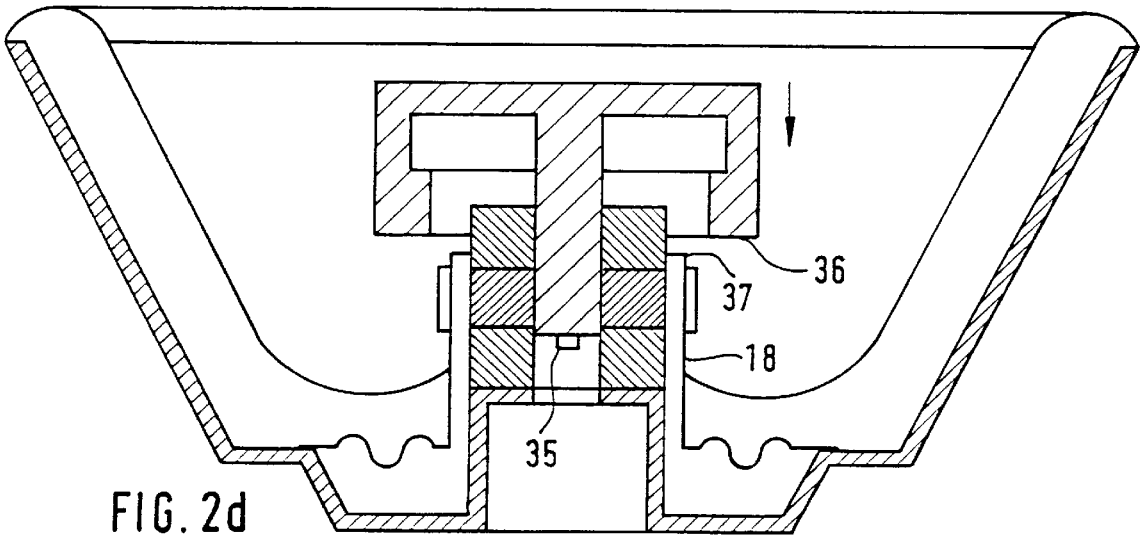

If the oscillating unit (13) is connected to the loudspeaker basket (11), the centering bushing (34) is removed in the opposite direction of the arrow in FIG. 2*c*. If at this point in time the core (20) is already connected to the pedestal (25), the installation peg (33) can also be removed from the centering hole (28) simultaneously with the centering bushing (34). If the latter conditions are not met, the installation peg (33) can also be pushed out by the centering peg (27) when it is being inserted into the centering hole (28) (not shown in FIG. 2*d*). In that case, if the free end of the centering peg (27) is equipped with a pin (35) which enters into a corresponding blind hole in the installation peg (33) (not shown in FIG. 2*d*), it ensures that the core (20) cannot move in the radial direction even if the upper end of the installation peg (33) leaves the pedestal opening (29). As is easy to see in this case the centering peg (27) should be made long enough to protrude from the pedestal opening (29) as illustrated in FIG. 1, because only then can it be ensured that the protruding end can also be used to connect the pot (19), the core (20) and the loudspeaker basket (11). Irrespective of the last configuration, the centering peg (27) should be long enough in every case so that when the centering peg (27) is inserted into the corresponding centering hole (28) of the first circular disk (disk 21 in FIG. 1), the lower edge (36) of the pot (19) is only at a small axial distance from the upper end (37) of the voice coil support (18). The reason is that it prevents damage to the voice coil support (18) or the voice coil (17) arranged thereon when the centering peg (27) is inserted into the centering hole (28) of the core (20). For reasons of completeness it should be pointed out here that when the two circular disks (21, 23) illustrated in FIG. 1 have a larger inside diameter than the pole disk (22), the peg (27) must be long enough so that it already enters into the centering hole (28) of the pole disk (22) before the lower edge (36) of the pot (19) can make contact with the upper end (37) of the voice coil support (18).

Figure 3:
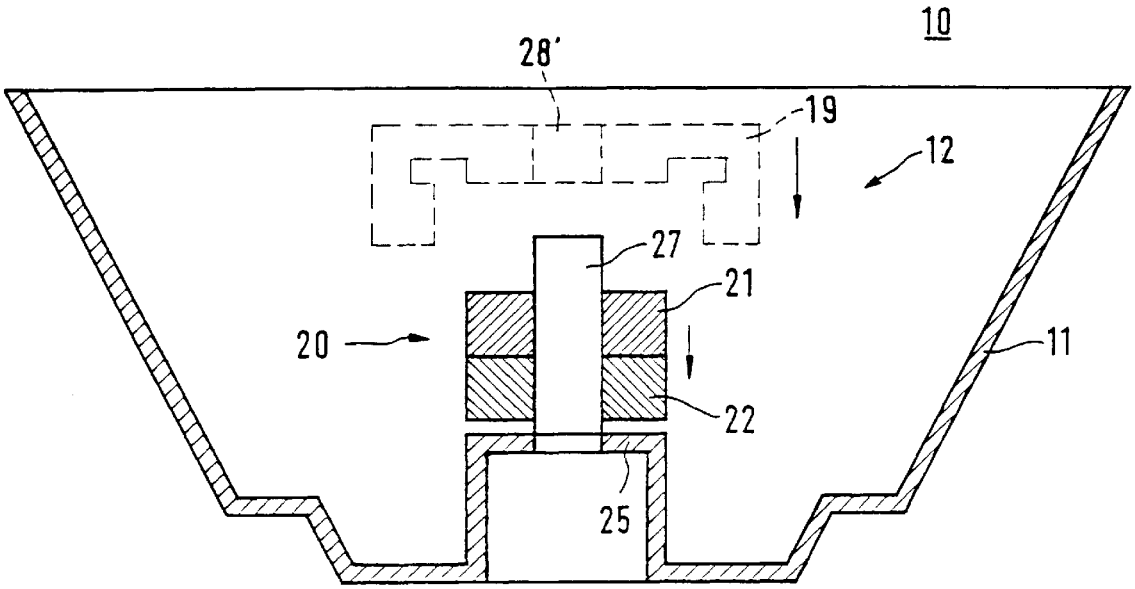
FIG. 3 illustrates a different configuration of a loudspeaker than FIG. 1.

FIG. 3 illustrates a different configuration of a loudspeaker than FIG. 1. In this configuration example as well the loudspeaker basket (11) is made of a paramagnetic or diamagnetic material. Differing however from the illustration in FIG. 1, the pedestal (25) is equipped with a centering peg (27). In the configuration example of FIG. 3 this centering peg (27) is made in one piece with the loudspeaker basket (11). A core (20) containing only a magnet part (21) and a pole disk (22) is pushed over this centering peg (27) as a one-piece unit. These conditions are indicated by the arrow next to the core (20). If an oscillating unit (13) of the type illustrated in FIG. 2*a* is now inserted into the arrangement of FIG. 3 (not illustrated therein), the magnet system (12) must still be completed by installing the pot (10) (drawn with broken lines in FIG. 3). In FIG. 3 this pot (19) is also equipped with a centering hole (28'). The pot (19) is installed on the centering peg (27) through the centering hole (28') as shown by the arrow next to the pot (19) and establishes the link between the latter and the centering peg (27). As can easily be seen in the arrangement of FIG. 3, the subsequent installation of the pot (19) also allows a centering bushing (34) to be placed between the core (20) and the voice coil support (18). The fact that the centering peg (27) in FIG. 3 is made of a paramagnetic or diamagnetic material achieves a better induction in the air gap (31) as compared to the arrangement in FIG. 1, because in this case the centering peg (27) material does not weaken the induction provided by the magnet system (12) by means of magnetic short circuits.

Figure 4:
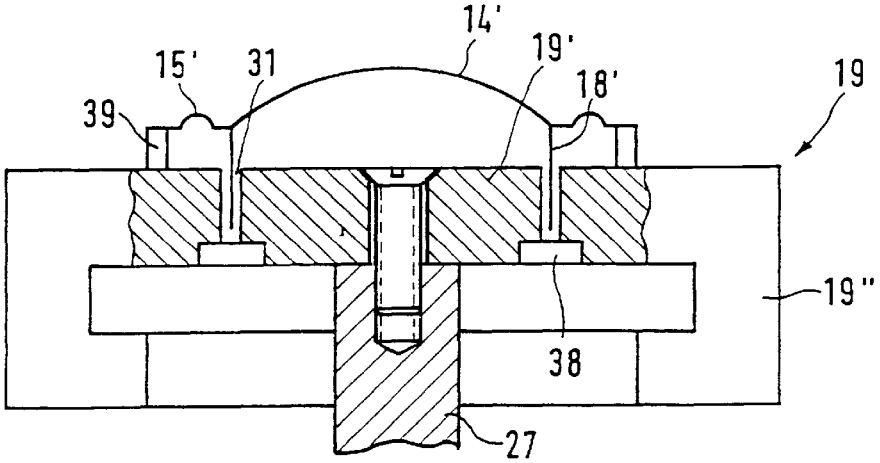
FIG. 4 illustrates a pot which is slightly modified with respect to the one in FIG. 1.

FIG. 4 illustrates a pot (19) which is slightly modified with respect to the one in FIG. 1. This pot (19) is formed of a bottom plate (19') and a pot edge (19"). The bottom plate (19') is connected to the pot edge (19") by a circular ring (38) made of a paramagnetic or diamagnetic material in a way so that a narrow air gap (31') exists radially with respect to the central axis. A further voice coil support (18') with a voice coil wound around it (not shown in FIG. 4) dips into this air gap (31'). The upper end of the voice coil support (18') is connected to a spherically shaped diaphragm (14'), which in turn is connected to the pot edge (19") by a peripheral bead (15') and an attachment border (39). The bottom plate (19') of the pot (19) is furthermore attached to a centering peg (27) by a screw. This centering peg (27) is made of a paramagnetic or diamagnetic material while the bottom plate (19') and the pot edge (19") are made of iron for example. If an arrangement according to FIG. 4 is now connected to the core (20) instead of the pot (19) in FIG. 1, by pushing the centering peg (27) into the centering hole (28) of the core (20), the magnetic flux provided in the air gap (31') by the two magnet parts (21, 23) can be used to drive the diaphragm (14'), which in this case has a spherical shape.

Figure 5:
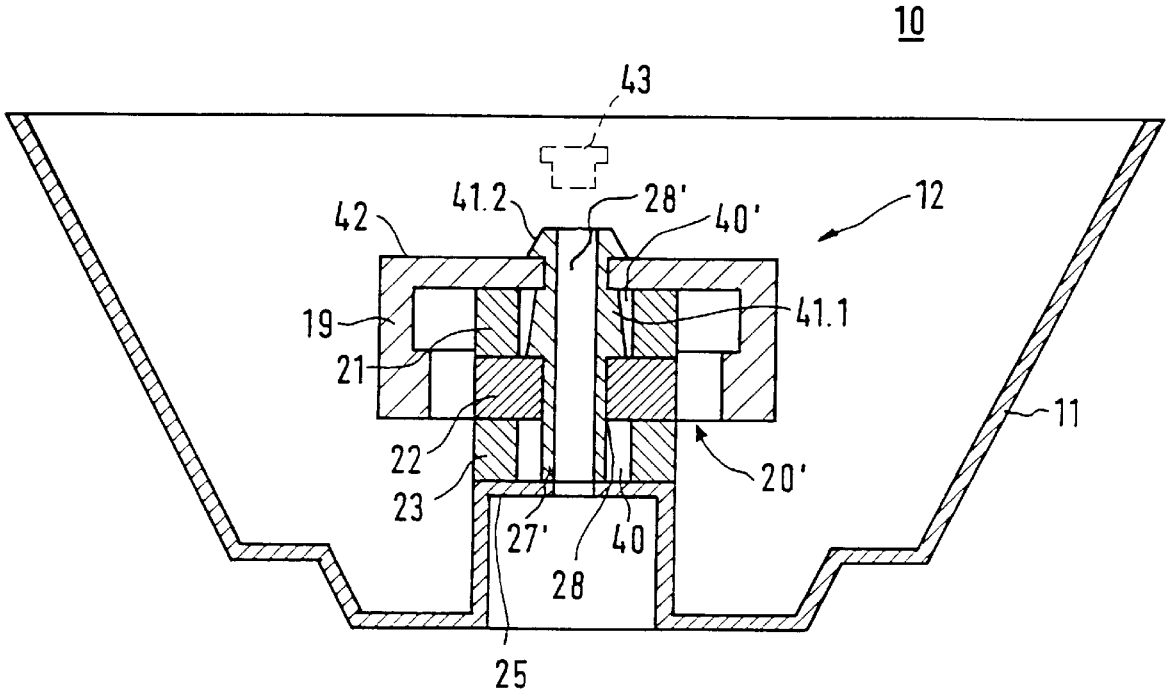
FIG. 5 illustrates a configuration of a loudspeaker that is similar to the one in FIG. 3.

FIG. 5 illustrates a configuration of a loudspeaker (10) that is similar to the one in FIG. 3. For reasons of clearer visibility the illustration of an oscillating unit (1 3) was omitted in this instance as well.

By contrast to the configuration in FIG. 3, the centering peg (27') in FIG. 5, which forms one unit with the loudspeaker basket (1 1), is not solid but hollow. Nor is the inside diameter of the core (20') which is formed of three circular disks (21–23), uniform in size. The inside diameter of the centering hole (28') in pot (19) corresponds to the inside diameter of the pole disk (22) so that, since the inside diameter of the magnet parts (21, 23) is smaller than the inside diameter of the pole disk (22), cuts (40) are provided between the pedestal (25) of the pole disk (22) or between the pole disk (22) and the pot (19) in the finished condition of the magnet system (12).

The outer jacket of the hollow centering peg (27') is not smooth-walled as in the other configuration examples, but is equipped with projections (41). As can clearly be seen in FIG. 5, the projection (41.1) enters into the cut (40') when the magnet system (12) is assembled. In this condition the projection (41.2) also rests on the pot surface (42). As is easy to see, when the core (20') is pushed over the centering peg (27') the projection (41.1) acts to secure the core (20') to the loudspeaker basket (11). Once the respective centering and attaching operations of the oscillating system (13) (not shown in FIG. 5) are completed and the pot (19) has been installed over the centering peg (27'), the latter penetrates into the centering hole (28') in pot (19). When the pot (19) has assumed its final position in the magnet system (12) as illustrated in FIG. 5, the projection (41.2) rests on the pot surface (42) thereby securing the magnet system (12) to the loudspeaker basket (11). To prevent this connection from loosening, at least the top opening of the hollow centering peg (27') can be closed with a plug (43) which in FIG. 5 is drawn by broken lines above the centering peg (27'), for easier visibility. The spreading effect of such a plug (43) on the projections (41) is pointed out.

It should be added in conclusion that the magnet systems (12) in FIGS. 1 to 5 can be closed with a dust protection cover (not illustrated) to protect the air gap (31).

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

I claim:

1. A loudspeaker with a magnet system (12) comprising a core (20) installed in a pot (19), with at least one magnet part (21, 23) and a pole disk (22) inserted into the pot (19), and a conical diaphragm (14), where most of the magnet system (12) is arranged inside a space (32) surrounded by the conical diaphragm (14), wherein at least the core (20) is equipped with a centering hole (28) or a centering blind hole, and a centering peg (27) is provided which is comprised of paramagnetic or diamagnetic material and in the finished condition of the magnet system (12) fills the respective centering hole (28) in the core (20) at least partially, and wherein the pot (19) is formed of a bottom disk (19') which is connected to the core (20), a pot edge (19") and a circular disk (38) made of a paramagnetic or diamagnetic material, where the circular disk (38) links the pot edge (19") and the bottom disk (19') but leaves an air gap (31') between the pot edge (19") and the bottom disk (19').

2. A loudspeaker as claimed in claim 1 wherein the at least one magnet part (21, 23) is made of neodymium.

3. A loudspeaker as claimed in claim 1, wherein the centering peg (27') is equipped with at least one projection (41), and the centering hole (28) is provided with cuts (40) such that in the assembled condition of the magnet system (12) the at least one projection (41) gets caught in one of the cuts (40).

4. A loudspeaker as claimed in claim 3, wherein the cut or cuts (40) are present because the inside diameter of the pole disk (22) is smaller than the inside diameter of the at least one magnet part (21, 23).

* * * * *